US005199589A

United States Patent [19]

Noble

[11] Patent Number: 5,199,589

[45] Date of Patent: Apr. 6, 1993

[54] COLLAPSIBLE BIX BOX ASSEMBLY FORMED OF TWO SEPARATE COLLAPSIBLE BIN BOXES

[76] Inventor: William L. Noble, 2146 Newport, Walled Lake, Mich. 48390

[21] Appl. No.: 919,337

[22] Filed: Jul. 27, 1992

[51] Int. Cl.[5] ..... B65D 6/22

[52] U.S. Cl. ..... 220/7; 220/1.5; 220/4.24; 220/4.33; 220/23.4; 220/683; 217/65; 217/15; 217/47

[58] Field of Search ..... 220/4.21, 4.24, 4.26, 220/4.27, 4.28, 4.33, 6, 7, 1.5, 23.4, 23.83, 23.86, 651, 666, 683, 693, 4.22; 217/13, 15, 45, 46, 47, 65

[56] References Cited

U.S. PATENT DOCUMENTS

| | | | |
|---|---|---|---|
| 1,133,851 | 3/1915 | Gentry | 217/47 |
| 2,530,481 | 11/1950 | Rawn, Jr. | 220/683 |
| 3,259,264 | 7/1966 | Best et al. | 217/65 |
| 3,404,818 | 10/1968 | Miscoe | 220/23.4 |
| 4,285,439 | 8/1981 | Dyer | 217/65 |
| 4,674,647 | 6/1987 | Gyenge et al. | 220/1.5 |
| 4,722,473 | 2/1988 | Sandrini et al. | 220/7 |
| 4,829,977 | 5/1989 | Valentine | 220/693 |
| 5,097,957 | 3/1992 | Adams, Jr. et al. | 220/7 |

FOREIGN PATENT DOCUMENTS

| | | | |
|---|---|---|---|
| 234033 | 6/1964 | Austria | 220/1.5 |
| 3600378 | 7/1987 | Fed. Rep. of Germany | 220/23.83 |

*Primary Examiner*—Allan N. Shoap
*Assistant Examiner*—S. Castellano
*Attorney, Agent, or Firm*—Edward A. Craig

[57] ABSTRACT

A collapsible bin box assembly formed of two separate collapsible bin boxes. The bin boxes are identical in construction having side and end walls constructed in a manner which permits them to be folded down upon the base, making the bin boxes collapsible. In order to form the bin box assembly from two separate identical bin boxes, the bin boxes are arranged end-to-end in substantially abutting relationship and with the side walls of the two bin boxes along each side of the assembly parallel and interconnected by splices. When the adjacent end walls of the two bin boxes are folded down flat, the enlarged bin box assembly has a capacity approximately double the capacity of either one of the bin boxes. The interconnected side walls are capable of swinging as a unit from the normal upright position of use to a collapsed position when the bin box assembly is empty.

5 Claims, 3 Drawing Sheets

COLLAPSIBLE BIX BOX ASSEMBLY FORMED OF TWO SEPARATE COLLAPSIBLE BIN BOXES

This invention relates generally to containers and refer more particularly to a collapsible bin box assembly formed of two separate collapsible bin boxes.

BACKGROUND AND SUMMARY OF THE INVENTION

Bin boxes, particularly those intended for industrial or commercial use, are employed to contain and/or transport a variety of products or parts. The side and end walls are often constructed in a manner which permits them to be folded down upon the base, making the bin box collapsible. When empty, the bin boxes can be collapsed so that they occupy less space.

Bin boxes are manufactured in different sizes depending on requirements. However, keeping an inventory of bin boxes of different sizes can be very costly.

One object of this invention is to provide a collapsible bin box assembly which can be made from two collapsible bin boxes. Thus the individual bin boxes may be used separately in a conventional manner, or two may be combined to provide an enlarged bin box assembly.

In accordance with a specific embodiment of the invention, two collapsible bin boxes are placed together end-to-end, and the adjacent end walls of the two bin boxes are folded down. The side walls at each side of the bin box assembly are interconnected, and together with the remote end walls of the two bin boxes, form an enlarged container of approximately double the capacity of either one of the bin boxes taken by itself.

The side walls of the two bin boxes from which the enlarged bin box assembly is formed are interconnected by a splice of novel construction. This splice has hooks which engage the adjacent edge portions of the side walls at each side of the bin box assembly, and preferably has a cap at one end for properly locating the splice with respect to the interconnected side walls. The splice has a part which is specially formed to fit in a recess along the adjacent edges of the side walls, to retain the hooks engaged with the side edge portions of the side walls.

The resulting enlarged bin box assembly is rigidly held together by the splices, and the interconnected side walls are capable of swinging as a unit from the normal upright position of use to a collapsed position when the bin box assembly is empty.

A further object of the invention is to provide a bin box assembly which is of rugged and durable construction, easy to manufacture, formed of a relatively few simple parts, and well designed for the accomplishment of its intended function.

Other objects, features and advantages of the invention will become more apparent as the following description proceeds, especially when considered with the accompanying drawings.

DETAILED DESCRIPTION

Referring now more particularly to the drawings, the bin box assembly 10 is composed of two identical bin boxes 12 and 14 and two identical splices 16 and 18.

Figure 4:
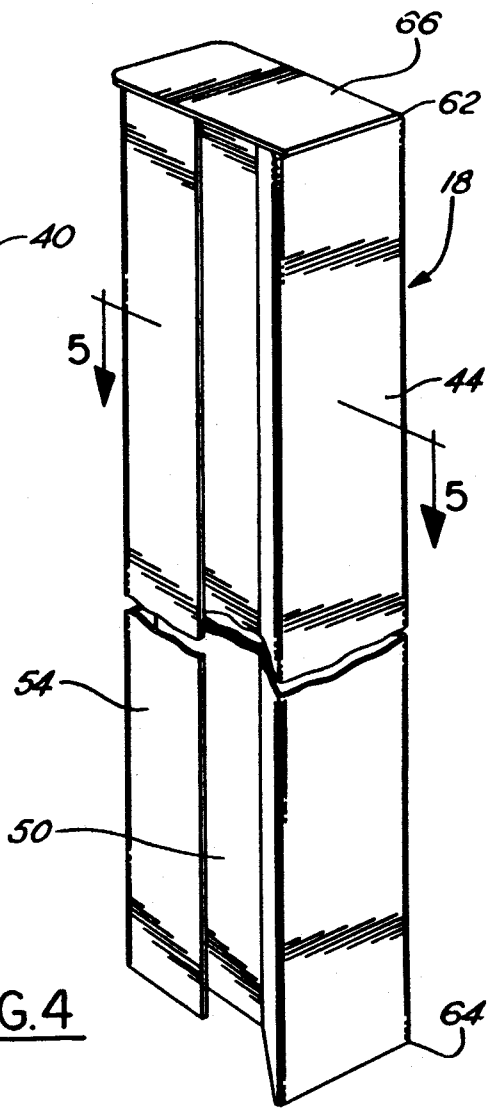
FIG. 4 is a perspective view of one of the splices.
Figure 1:
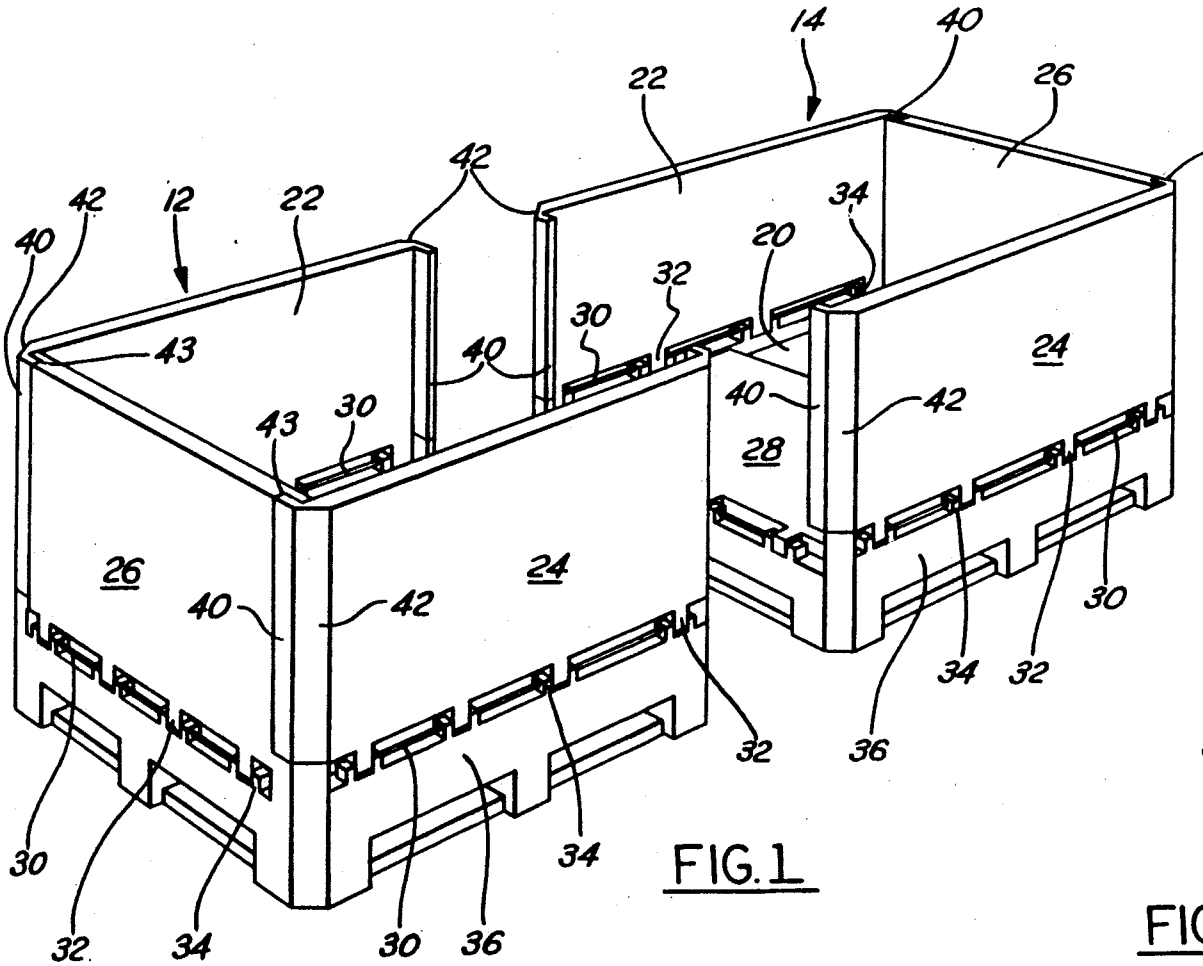
FIG. 1 is a perspective view showing two collapsible bin boxes positioned adjacent to one another prior to having their adjacent side walls interconnected to form an enlarged bin box assembly of this invention.
Figure 2:
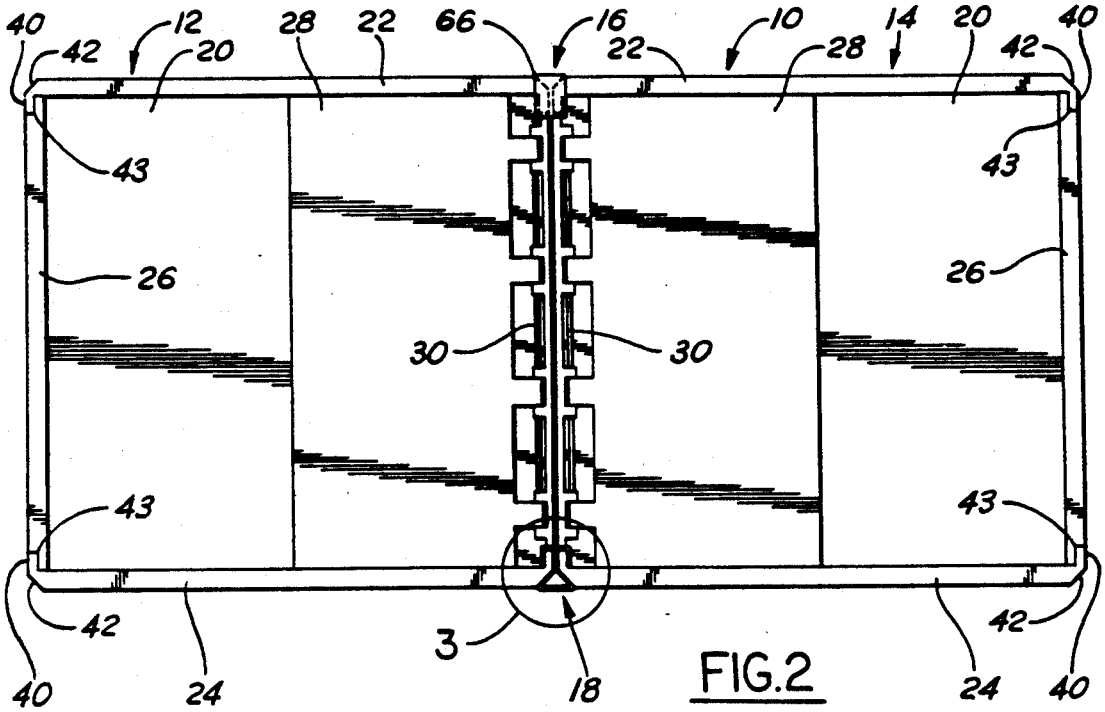
FIG. 2 is a top plan view of the bin box assembly with the adjacent side walls of the two bin boxes interconnected by splices and with the end cap of one splice removed for clarity, constructed in accordance with the invention.
Figure 3:
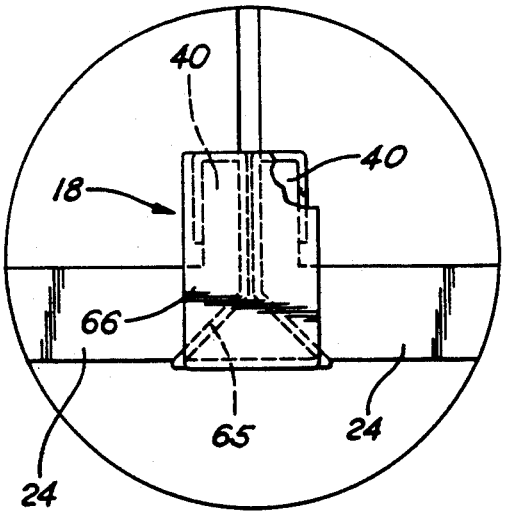
FIG. 3 is an enlarged fragmentary view of a portion of the structure of FIG. 2 shown within the circle 3.

Each bin box has a flat rectangular base 20, side walls 22 and 24 and end walls 26 and 28. The side and end walls are hinged to the base by horizontal rods 30 passing through spaced projections 32 on the lower edges of the walls and through spaced projections 34 along the sides and ends of the base. The side and end walls are capable of swinging from a normal upright or erect position to a collapsed position folded down flat upon the base. FIG. 1 shows each box with side walls 22 and 24 upright, the remote end walls 26 upright and the adjacent end walls 28 folded flat upon the base.

The base has raised side edge portions 36 upon which the side projections 34 are formed, so that the side hinge rods are located at a level above the end hinge rods. Therefore, when swinging the side and end walls to the folded position, the end walls are folded first and then the side walls are folded over the end walls.

The height of the side walls is slightly less than one half of the width of the base, and the height of the end walls is slightly less than one half of the length base, so that when folded, the swinging edges of the end walls nearly touch but do not overlap, and the swinging edges of the side walls likewise nearly touch but do not overlap.

The side edge portions of the side walls 22 and 24 extend laterally inwardly to provide parallel flanges 4 disposed at substantially 90 degrees to the plane of the side walls. The outer edges of the side edge portions of the side walls have surfaces 42 beveled at a 45 degree angle to the plane of the side walls.

The side edge portions of the end walls 26 and 28 have recesses 43 which receive the flanges 40 of the end walls when the side and end walls are upright. The side walls are maintained in their upright positions by the end walls. Any suitable means may be provided to releasably hold the end walls upright, even the frictional contact between the flanges 40 and recesses 43.

Figure 5:
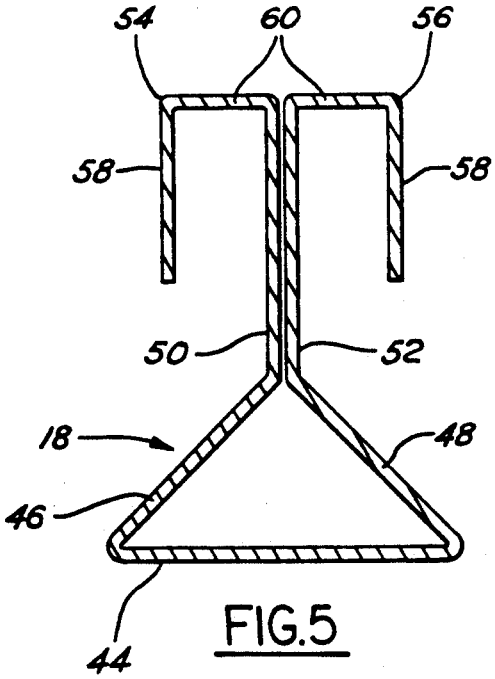
FIG. 5 is a sectional view taken on the line 5—5 in FIG. 4.

Each of the splices 16 and 18 is an elongated member made of metal or like material which is relatively stiff yet capable of being bent and shaped from a flat plate into the cross section shown in FIG. 5.

Each splice has a longitudinally extending midsection 44 of generally triangular configuration having tapered sides 46 and 48 preferably disposed at an angle of about 90 degrees to one another.

The splices also have side sections 50 and 52 which extend from the adjacent ends of the sides 46 and 48 in parallel, confronting, almost abutting relationship. The longitudinal edge portions of the side sections are return-bent laterally outwardly to provide hooks 54 and 56. Preferably these hooks have terminal portions 58 parallel to the side sections 50, 52 and connecting portions 60 at right angles to the side sections 50, 52 and terminal portions 58. The splices have the configuration of FIG. 5 from one end 62 to the other end 64. A rectangular cap 66 is secured to the end 62 of each splice.

In order to form the enlarged bin box assembly 10 from the separate bin boxes 12 and 14, the bin boxes 12 and 14, as shown in FIG. 1 with their adjacent end walls 28 folded down upon the bases 20 thereof, are moved together in end-to-end substantially abutting relationship with the side walls along each side of the assembly parallel and the adjacent flanges 40 of such side walls in closely spaced, parallel relation. The beveled surfaces 42 of the side walls at each side of the assembly together form a recess 65.

The splices are then applied by slipping them down, uncapped end first, over the adjacent flanges 40 at each side of the assembly. The side sections 50, 52 of each splice extend between the adjacent flanges 40, the hooks engage over the outer edges of the flanges 40, and the midsection 44 fits into the recess 65 formed by the beveled surfaces 42 of the adjacent side edge portions of the side walls. It will be noted that the angle formed by the beveled surfaces 42 of the side walls is approximately 90 degrees and substantially matches the angle between the sides 46 and 48 of the midsection 44 of the splice. This midsection, by its engagement in the recess 65 formed by surfaces 42, retains the hooks engaged with flanges 40.

The splices are slid down on the parallel flanges 40 until the caps 66 at the end 62 of the splices engage the swinging edge portions of the side walls, thereby locating the splices and preventing them from any further downward sliding movement.

Figure 6:
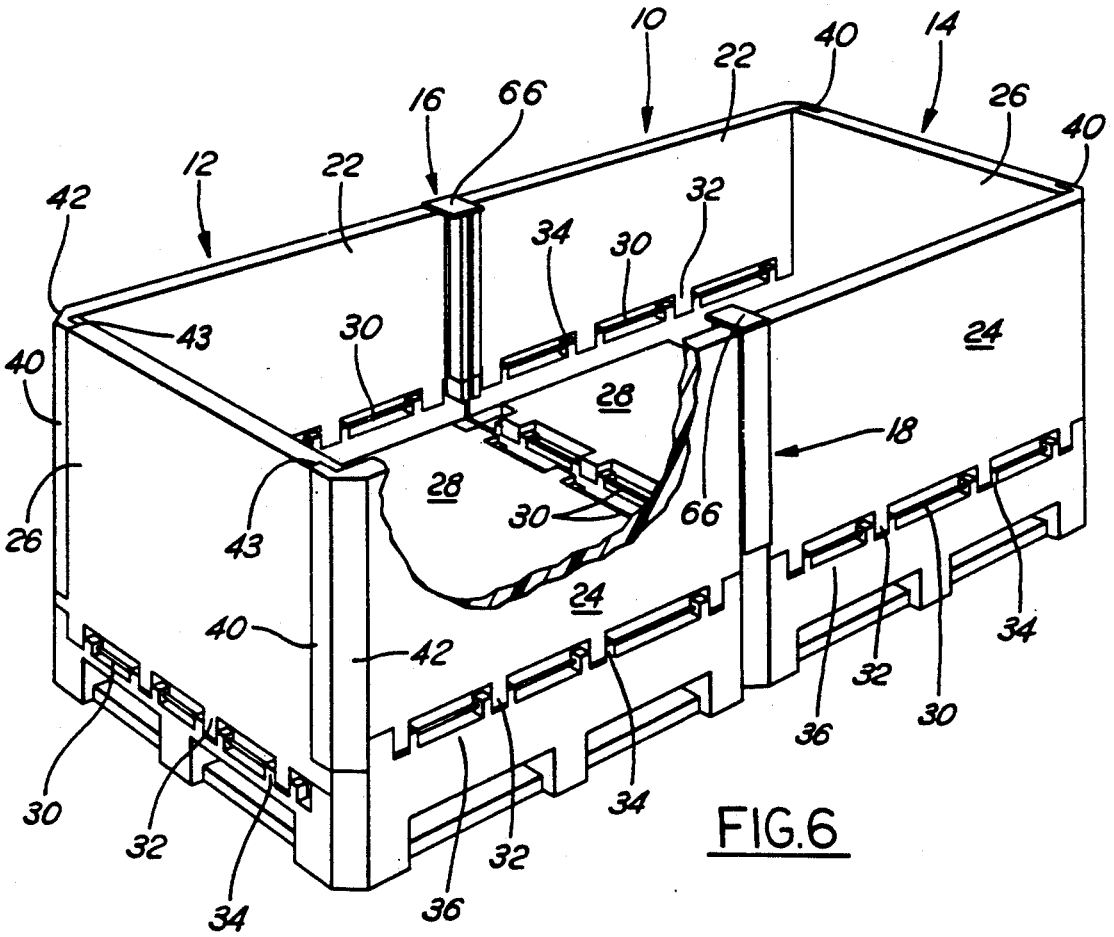
FIG. 6 is a perspective view with parts broken away showing the bin box assembly of this invention in condition to receive the parts or products to be contained, with the adjacent end walls of the two bin boxes folded down flat upon their bases and the remote end walls and the side walls erect.
Figure 7:
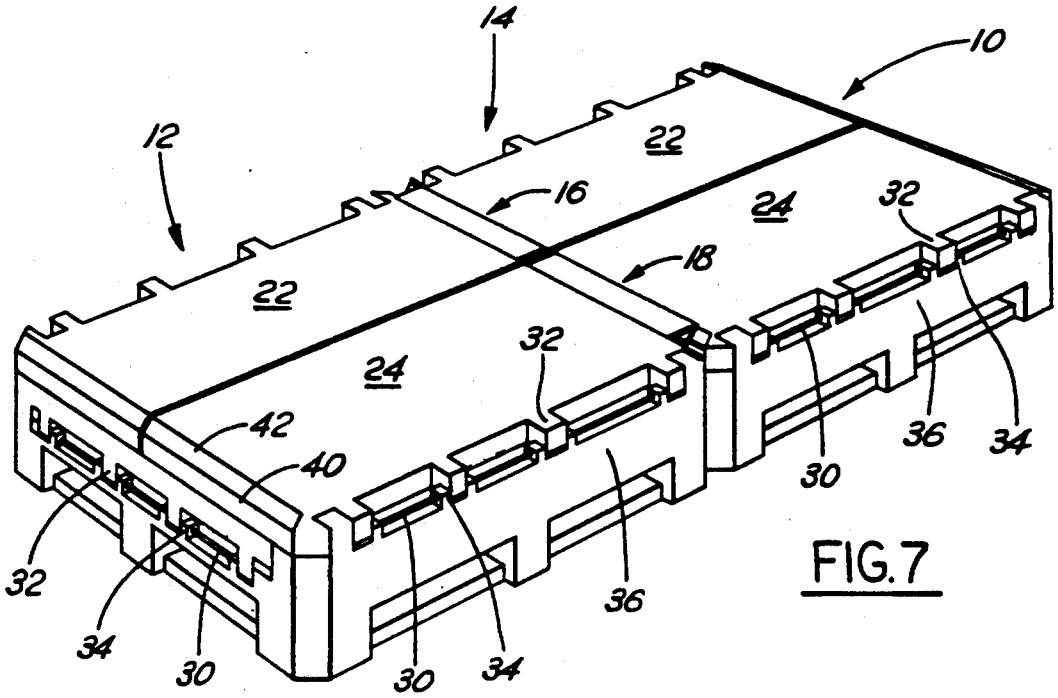
FIG. 7 is a perspective view showing the bin box assembly empty and with the side and end walls collapsed to a position convenient for storage or return of the empty bin box assembly.

The splices 16 and 18 interconnect the side walls on each side of the enlarged bin box assembly 10, enabling them to be swung from the normal erect position shown in FIG. 6 to the collapsed position of FIG. 7. The splices 16 and 18 are shorter than the distance between the swinging edges of the side walls and the hinged edges thereof, so as not to interfere with the folding of the side walls when spliced together. Before collapsing the interconnected side walls of the enlarged bin box assembly, the end walls 26 are first folded to the collapsed position.

What is claimed is:

1. A collapsible bin box assembly comprising two separate, collapsible bin boxes, each of said bin boxes having (a) a horizontal, rectangular base, (b) end walls hinged to opposite ends of said base for swinging movement from upright positions inwardly to positions overlying said base, and (c) side walls hinged to opposite sides of said base for swinging movement from upright positions inwardly to positions overlying said base, said bin boxes being disposed in end-to-end relationship (a) with their adjacent ends substantially abutting, (b) with said end walls at said adjacent ends of said bases turned inwardly to said positions overlying said bases, (c) with said end walls at the remote ends of said bases upright, and (d) with the side walls of said bin boxes at each side of said bin box assembly aligned with one another and upright and their adjacent side edge portions parallel, and a splice for interconnecting the side walls at each side of said bin box assembly, each splice comprising an elongated plate having a longitudinally extending midsection and longitudinally extending side sections, each splice being folded along said longitudinally extending midsection to place the side sections thereof in parallel, confronting, substantially abutting relationship, said side sections of each splice being disposed between said side walls and having generally U-shaped hooks engaging and interconnecting said adjacent, parallel side edge portions of said side walls, and said side walls at each side of said bin box assembly and said splice interconnecting them being swingable as a unit from the upright positions of said side walls to said positions overlying said bases and vice versa.

2. A collapsible bin box assembly according to claim 1, wherein each said splice has a cap a' one end thereof engaging the upper edges of said side walls to retain said splice from slipping downwardly relative to said side walls.

3. A collapsible bin box assembly according to claim 1, wherein said adjacent side edge portions of the side walls at each side of said bin box assembly extend laterally inwardly to provide parallel flanges with which said hooks engage, and the longitudinal edge portions of said side sections of each splice are return-bent to provide said hooks on the outer sides of said side sections.

4. A collapsible bin box assembly according to claim 3, wherein the laterally outer extremities of said side edge portions of the side walls at each side of said bin box assembly are beveled and cooperate to provide a tapered recess, and said midsection of each said splice has tapered sides to fit in said recess and thereby retain said hooks engaged with said flanges.

5. A collapsible bin box assembly according to claim 4, wherein each said splice is slidable endwise into engagement with said side edge portions of said side walls to an operative position and has a cap at one end thereof engaging the upper edges of said side walls to retain said splice from slipping downwardly relative to said side walls beyond said operative position.

* * * * *

UNITED STATES PATENT AND TRADEMARK OFFICE

CERTIFICATE OF CORRECTION

PATENT NO. :5,199,589
DATED :April 6, 1993
INVENTOR(S) :Nobel, et. al.

It is certified that error appears in the above-indentified patent and that said Letters Patent is hereby corrected as shown below:

On the Title page, item [73], Assignee: insert--Chrysler Corporation--.

Signed and Sealed this

Twenty-eighth Day of June, 1994

Bruce Lehman

*Attest:*

BRUCE LEHMAN

*Attesting Officer*

*Commissioner of Patents and Trademarks*